US008517697B2

(12) United States Patent
Kinjo et al.

(10) Patent No.: US 8,517,697 B2
(45) Date of Patent: Aug. 27, 2013

(54) SEALED COMPRESSOR AND REFRIGERATION DEVICE

(75) Inventors: Kenji Kinjo, Shiga (JP); Ko Inagaki, Shiga (JP); Masakazu Yamaoka, Shiga (JP)

(73) Assignee: Panasonic Corporation, Osaka (JP)

( * ) Notice: Subject to any disclaimer, the term of this patent is extended or adjusted under 35 U.S.C. 154(b) by 69 days.

(21) Appl. No.: 13/145,467

(22) PCT Filed: Feb. 9, 2010

(86) PCT No.: PCT/JP2010/000760

§ 371 (c)(1),
(2), (4) Date: Jul. 20, 2011

(87) PCT Pub. No.: WO2010/092790

PCT Pub. Date: Aug. 19, 2010

(65) Prior Publication Data

US 2011/0271709 A1 Nov. 10, 2011

(30) Foreign Application Priority Data

Feb. 13, 2009 (JP) ..... 2009-030786

(51) Int. Cl.
*F04B 39/00* (2006.01)

(52) U.S. Cl.
USPC ..... 417/312; 181/429; 181/449; 181/803; 417/902

(58) Field of Classification Search
USPC ..... 417/312, 902; 181/429, 449, 803
See application file for complete search history.

(56) References Cited

U.S. PATENT DOCUMENTS

| | | | | |
|---|---|---|---|---|
| 6,010,314 | A | 1/2000 | Kobayashi et al. | |
| 2009/0004031 | A1 * | 1/2009 | Umeoka et al. | 417/312 |

FOREIGN PATENT DOCUMENTS

| | | |
|---|---|---|
| JP | 50-031504 | 7/1973 |
| JP | 52-050008 | 4/1977 |
| JP | 57-057288 U | 4/1982 |
| JP | 59-096383 | 6/1984 |
| JP | 1-102485 | 7/1989 |
| JP | 10-196540 | 7/1998 |
| JP | 2003-042064 | 2/2003 |
| JP | 2007-016646 | 1/2007 |
| WO | 2008/069334 | 6/2008 |

* cited by examiner

*Primary Examiner* — Charles Freay
*Assistant Examiner* — Patrick Hamo
(74) *Attorney, Agent, or Firm* — Hamre, Schumann, Mueller & Larson, P.C.

(57) ABSTRACT

There is disclosed a sealed compressor in which a compressive component housed inside of a sealed container comprises a block, a suction valve, a piston, and a suction muffler, the suction muffler including a muffler body defining a muffler space and an outlet tube communicating the muffler space with the suction valve, the outlet tube having a bent portion bent in a middle portion between an opening exposed to the muffler space and an opening in a vicinity of the suction valve, a first outlet tube portion extending from the bent portion toward the muffler space, and a second outlet tube portion extending from the bent portion toward the suction valve, wherein a close sided space is formed in a vicinity of the bent portion, the close sided space having one end in communication with the outlet tube and the other end closed.

4 Claims, 4 Drawing Sheets

SEALED COMPRESSOR AND REFRIGERATION DEVICE

TECHNICAL FIELD

The present invention relates to a sealed compressor and a refrigeration device.

BACKGROUND ART

Demands for globally environmental protection have been increased in recent years. High efficiency, in particular, has been strongly required in a refrigerator and other refrigeration cycle devices.

In the prior art, a sealed compressor of this type is exemplified by using a suction muffler made of a resin (see, for example, Patent Document 1). Hereinafter, the above-described sealed compressor in the prior art will be explained with reference to the drawings.

FIG. 3 is a vertical cross-sectional view showing a sealed compressor in the prior art disclosed in Patent Document 1; and FIG. 4 is a vertical cross-sectional view showing a suction muffler in the sealed compressor.

With reference to FIGS. 3 and 4, at a bottom of sealed container 1, oil 3 is reserved and refrigerant 5 is filled. Compressor body 7 is resiliently supported with respect to sealed container 1 via suspension spring 9.

Compressor body 7 is provided with electromotive component 11 and compressive component 13 disposed above electromotive component 11. Electromotive component 11 includes stator 15 and rotor 17.

Compressive component 13 is provided with crankshaft 23, block 29, piston 31, valve plate 33, suction valve 37, and connector 39. Here, crankshaft 23 includes eccentric shaft 19 and main shaft 21. Block 29 is formed integrally with cylinder 27 defining compression chamber 25. Connector 39 is adapted to connect eccentric shaft 19 and piston 31 to each other. Suction valve 37 is designed to open or close suction port 35, which is formed in valve plate 33 for sealing an end face of cylinder 27.

Main shaft 21 of crankshaft 23 is rotatably pivoted on bearing 41 of block 29. Moreover, to main shaft 21 is fixed rotor 17. Furthermore, crankshaft 23 is equipped with oil supply mechanism 43 including a spiral groove formed on main shaft 21, and the like.

Additionally, valve plate 33 attached to the end face of cylinder 27 and cylinder head 45 for closing valve plate 33 securely hold suction muffler 47 therebetween.

Suction muffler 47 is molded of a resin such as PBT (i.e., polybutylene terephthalate). Suction muffler 47 includes muffler body 51, inlet tube 53, and outlet tube 55, and further, is provided with oil drain port 57 at a lower end of muffler body 51. Here, muffler body 51 defines muffler space 49. Muffler space 49 communicates with a space defined inside of sealed container 1 via inlet tube 53. In addition, muffler space 49 communicates with compression chamber 25 via outlet tube 55.

Outlet tube 55 includes bent portion 59, first outlet tube portion 61, and second outlet tube portion 63. First outlet tube portion 61 and second outlet tube portion 63 are continuous to each other at a right angle. Here, bent portion 59 is obtained by bending a tube in the middle between an opening exposed to muffler space 49 and an opening formed in a vicinity of suction valve 37. First outlet tube portion 61 extends from bent portion 59 toward muffler space 49. Second outlet tube portion 63 extends from bent portion 59 toward suction valve 37.

A description will be given below of the operation of the sealed compressor such configured as described above in the prior art disclosed in Patent Document 1.

First, a current flows in stator 15, thereby generating a magnetic field in the sealed compressor. Crankshaft 23 is rotated by rotating rotor 17 fixed to main shaft 21, so that piston 31 makes a reciprocal motion inside of cylinder 27 via connector 39 rotatably fixed to eccentric shaft 19.

The reciprocal motion of piston 31 allows refrigerant 5 to be repeatedly sucked to compression chamber 25, compressed therein, and discharged to a refrigeration cycle, not shown.

In a suction stroke, refrigerant 5 which has been returned from the refrigeration cycle is introduced into compression chamber 25 from suction muffler 47 through suction port 35 communicating with compression chamber 25 by opening or closing suction valve 37.

Here, suction muffler 47 reduces noise generated by intermittent suction of refrigerant 5, and further, prevents refrigerant 5 passing through suction muffler 47 from being heated since it is made of a resin having a small thermal conductivity.

Since bent portion 59 is formed in outlet tube 55, a height of suction muffler 47 can be reduced, and therefore, suction muffler 47 can be used in a sealed compressor having a small height.

On the other hand, oil supply mechanism 43 carries oil 3 from the bottom of sealed container 1 to compressive component 13 by utilizing a centrifugal force or the like generated by the rotation of crankshaft 23.

Carried oil 3 lubricates crankshaft 23 and a slide portion such as bearing 41, and then, spatters inside of sealed container 1 from an upper end of crankshaft 23, so as to lubricate piston 31, cylinder 27, and the like. Thereafter, spattering oil 3 adheres to sealed container 1, and then, flows down to the bottom along an inner wall of sealed container 1. In the meantime, heat is transmitted from oil 3 to sealed container 1, to then radiate from sealed container 1 to an outside, thus cooling the sealed compressor.

Moreover, oil 3 spattering inside of sealed container 1 is sucked also into suction muffler 47 together with refrigerant 5. Oil 3 sucked together with refrigerant 5 is separated from refrigerant 5 when refrigerant 5 released from inlet tube 53 into muffler space 49 is reduced in flow rate. Most of separated oil 3 resides at the bottom of muffler body 51, and then, is drained outside of suction muffler 47 through oil drain port 57.

However, with the configuration in the prior art, a part of oil 3 spattering inside of muffler space 49 cannot fall but adheres onto the inner wall of muffler space 49 or an outer surface of outlet tube 55. In particular, oil 3 adhering to the outer surface of outlet tube 55 is urged by a flow of refrigerant 5 flowing from inlet tube 53, to be moved toward the opening exposed to muffler space 49 in first outlet tube portion 61, and further, oil droplets are formed during the movement. The droplets of oil 3 are urged by the flow of refrigerant 5, and thus, are moved along the inner wall of outlet tube 55, as indicated by arrows in FIG. 4, thereby raising a possibility that oil 3 flows into compression chamber 25 in a large amount.

If oil 3 flows into compression chamber 25 in a large amount, an increased load during compression may increase an input or inhibit refrigerant 5 from being sufficiently compressed, resulting in degraded refrigeratory efficiency. Worse still, abrupt fluctuations in compressive load may induce generation of noise.

Alternatively, if oil 3 flows into the refrigeration cycle in a large amount, a heat exchanger may be degraded.

Patent Document 1

Unexamined Japanese Patent Publication No. 2003-42064

DISCLOSURE OF THE INVENTION

A sealed compressor according to the present invention houses, inside of a sealed container, a compressive component driven by an electromotive component, the compressive component comprising: a block defining a compression chamber; a suction valve disposed at an end of the compression chamber; a piston which makes a reciprocating motion inside of the compression chamber; and a suction muffler defining a muffler space communicating with the compression chamber, the suction muffler including: a muffler body defining the muffler space; and an outlet tube communicating the muffler space with the suction valve, the outlet tube having: a bent portion bent in a middle portion between an opening exposed to the muffler space and an opening in the vicinity of the suction valve; a first outlet tube portion extending from the bent portion toward the muffler space; and a second outlet tube portion extending from the bent portion toward the suction valve; wherein a close sided space is formed in the vicinity of the bent portion, the close sided space having one end in communication with the outlet tube and the other end closed.

With the sealed compressor having the above-described configuration, the oil which is to flow into the compression chamber along the inner wall of the outlet tube is separated by the effect of the close sided space. Thus, it is possible to prevent the oil from flowing into the compression chamber in a large amount, so as to reduce noise and stabilize performance.

PREFERRED EMBODIMENTS FOR CARRYING OUT THE INVENTION

Hereinafter, a description will be given of an embodiment according to the present invention with reference to the drawings.

Embodiment

Figure 1:
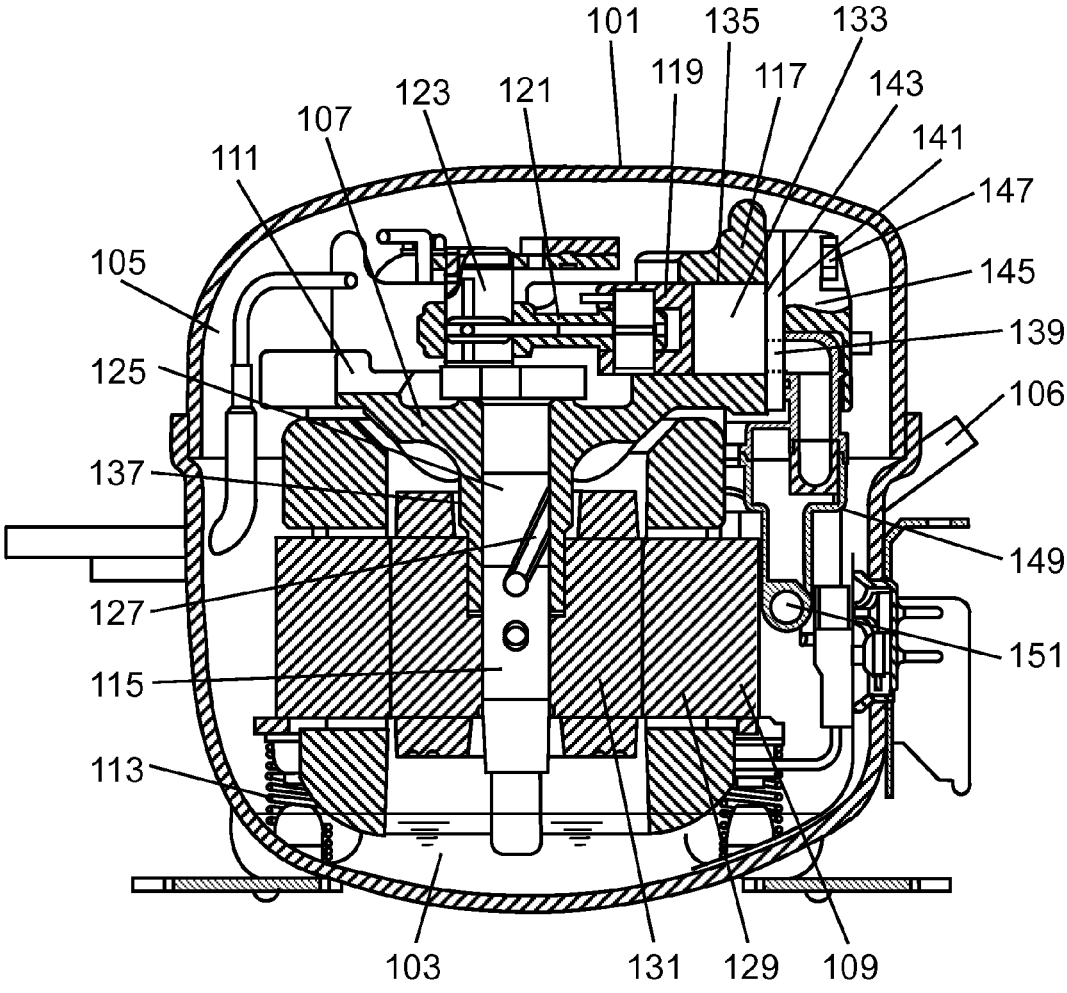
FIG. 1 is a vertical cross-sectional view showing a sealed compressor in an embodiment according to the present invention.
Figure 2:
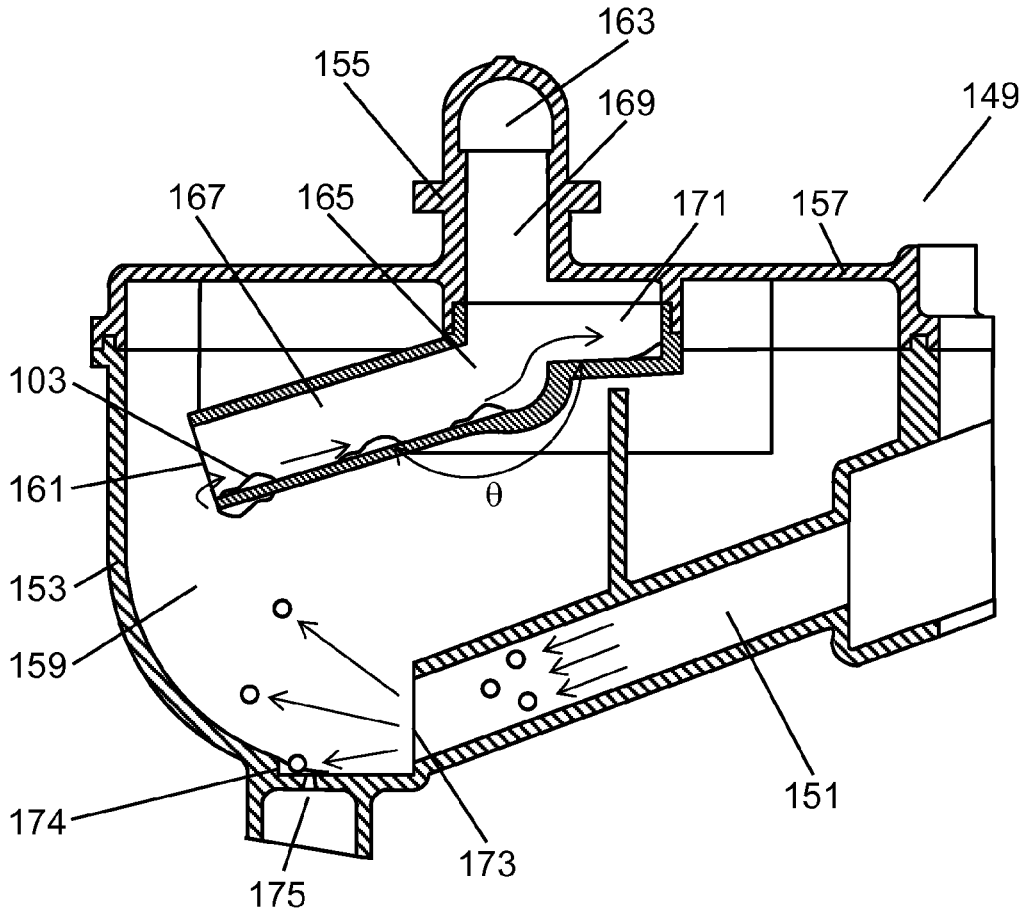
FIG. 2 is a vertical cross-sectional view showing a suction muffler in the sealed compressor.
Figure 3:
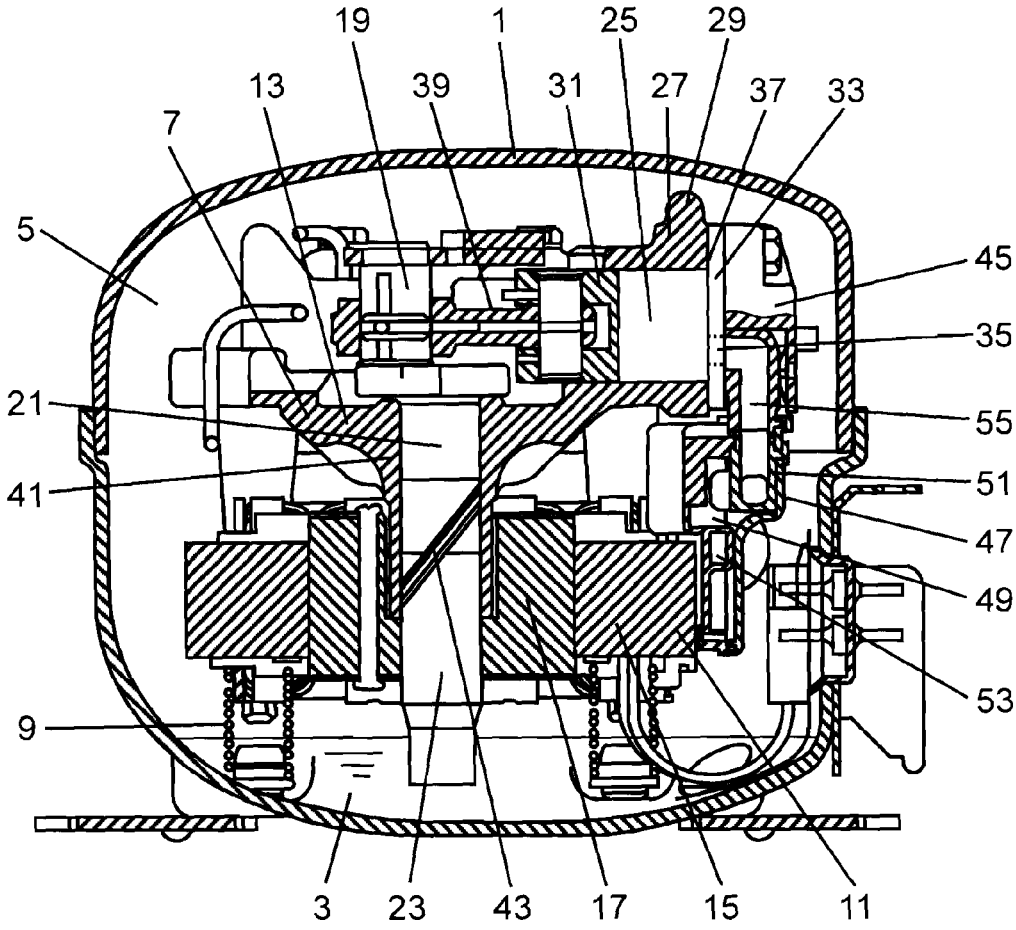
FIG. 3 PRIOR ART
FIG. 3 is a vertical cross-sectional view showing a sealed compressor in the prior art.
Figure 4:
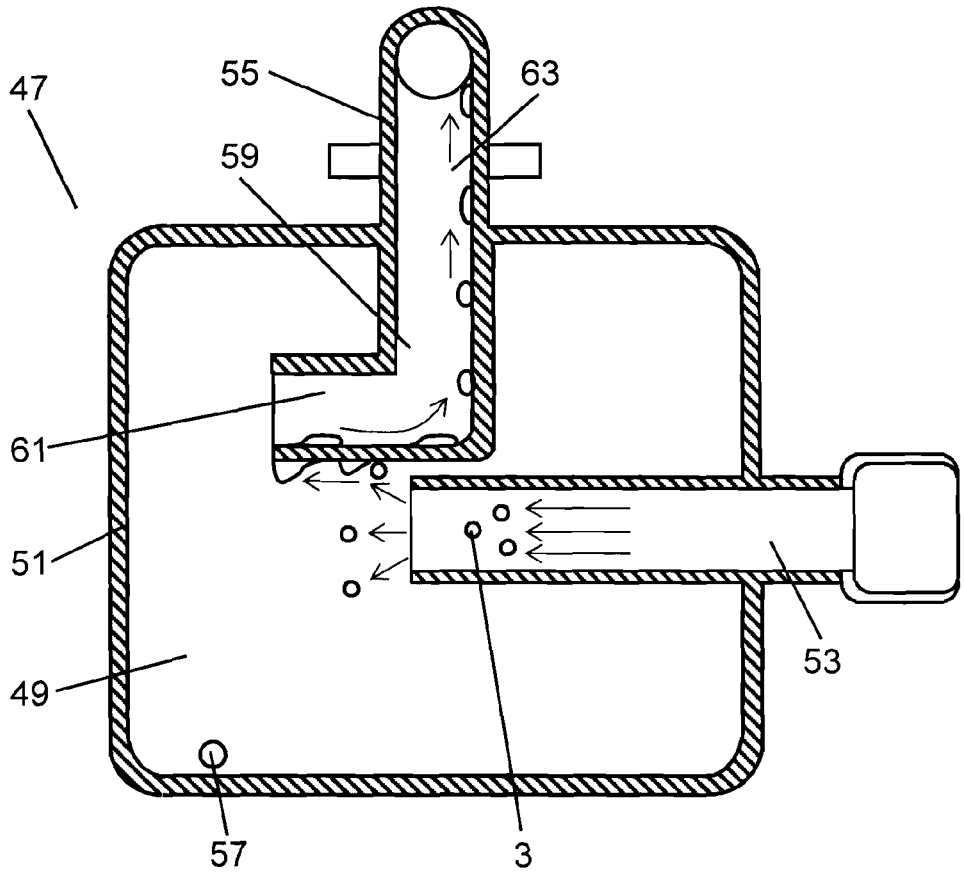
FIG. 4 PRIOR ART
FIG. 4 is a vertical cross-sectional view showing a suction muffler in the sealed compressor.

FIG. 1 is a vertical cross-sectional view showing a sealed compressor in an embodiment according to the present invention; and FIG. 2 is a vertical cross-sectional view showing a suction muffler in the sealed compressor.

With reference to FIGS. 1 and 2, in a sealed compressor in an embodiment according to the present invention, oil 103 is reserved at an inner bottom of sealed container 101, and further, refrigerant 105 such as R600a is sealed. Here, R600a is a hydrocarbon-based refrigerant having a low global warming factor.

Sealed container 101 is molded by drawing an iron plate. Sealed container 101 is provided with suction pipe 106. Suction pipe 106 communicates with an inside of sealed container 101 at one end thereof whereas it is connected onto a low pressure side, not shown, of a refrigeration cycle at the other end thereof.

Inside sealed container 101, compressor body 111 including compressive component 107 and electromotive component 109 is resiliently supported with respect to sealed container 1 by suspension spring 113, and thus, is housed.

Compressive component 107 is constituted of crankshaft 115, block 117, piston 119, connector 121, and the like. Crankshaft 115 includes eccentric shaft 123 and main shaft 125, and further, includes oil supply mechanism 127 such as a spiral groove formed on main shaft 125.

Electromotive component 109 is constituted of stator 129 and rotor 131. Here, stator 129 is fixed to a lower portion of block 117 via a bolt, not shown. Rotor 131 is disposed coaxially with main shaft 125 located inward of stator 129, to be shrink-fitted to main shaft 125. Electromotive component 109 is adapted to drive compressive component 107.

Cylinder 135 defining compression chamber 133 is formed integrally with block 117. Block 117 is provided with bearing 137 for rotatably pivoting main shaft 125.

Valve plate 141, suction valve 143, and cylinder head 145 are fixed to an end face of cylinder 135 by head bolt 147 under pressure in such a manner as to seal the end face of cylinder 135. Suction muffler 149 is securely grasped by valve plate 141 and cylinder head 145. Here, valve plate 141 has suction port 139 and a drain port, not shown. Suction valve 143 is adapted to open or close suction port 139.

Suction muffler 149 is made by molding a synthetic resin such as PBT mainly added with glass fiber. Muffler space 159 is defined by integrally combining muffler body 153 molded integrally with inlet tube 151 forming a part of an inclined outer wall in suction muffler 149 and cover 157 provided with outlet tube 155. In other words, suction muffler 149 includes muffler body 153 defining muffler space 159 and outlet tube 155 communicating muffler space 159 with suction valve 143.

On the other hand, compressive component 107 is provided with block 117 defining compression chamber 133, suction valve 143 disposed at an end of compression chamber 133, piston 119 which makes a reciprocating motion inside of compression chamber 133, and suction muffler 149 defining muffler space 159 communicating with compression chamber 133.

In the meantime, outlet tube 155 has bent portion 165 which is bent at a middle portion between opening 161 exposed to muffler space 159 and opening 163 in a vicinity of suction valve 143. Moreover, outlet tube 155 is constituted of first outlet tube portion 167 and second outlet tube portion 169. Here, first outlet tube portion 167 extends from bent portion 165 toward muffler space 159, and further, is formed with an inclination such that opening 161 exposed to muffler space 159 is vertically located under bent portion 165. Second outlet tube portion 169 extends substantially perpendicularly from bent portion 165 toward suction valve 143, and further, is molded integrally with cover 157.

Additionally, close sided space 171 is defined above in a vicinity of bent portion 165 inside of outlet tube 155. One end of close sided space 171 communicates with outlet tube 155 whereas the other end thereof is closed. Furthermore, close sided space 171 is formed in such a manner that its shape is defined by first outlet tube portion 167 and second outlet tube portion 169.

A bottom of close sided space 171 is formed with an inclination such that first outlet tube portion 167 is located under in a vertical direction. Angle θ between a lower portion of first outlet tube portion 167 and a bottom of close sided space 171 is set to 163° in such a manner as to be substantially parallel to the inclination of inlet tube 151 in the present embodiment.

Opening 173 of inlet tube 151, exposed to muffler space 159 is formed in a vicinity of a bottom of muffler space 159, and further, step 174 facing opening 173 of inlet tube 151 is formed at a bottom of muffler body 153 in a vicinity of opening 173. Oil drain port 175 is formed between step 174 and opening 173.

A description will be given below of the operation and function of the sealed compressor such configured as described above.

A current flows in stator 129, thereby generating a magnetic field in the sealed compressor, so as to rotate rotor 131 fixed to main shaft 125. Consequently, crankshaft 115 is rotated, so that piston 119 makes a reciprocal motion inside of cylinder 135 via connector 121 rotatably fixed to eccentric shaft 123. The reciprocal motion of piston 119 allows refrigerant 105 to be sucked to compression chamber 133 via suction muffler 149, compressed therein, and discharged to a refrigeration cycle, not shown.

Next, explanation will be made on a suction stroke in the sealed compressor.

When piston 119 is operated from a top dead center in a direction in which a volume inside of compression chamber 133 is increased, refrigerant 105 staying in compression chamber 133 is expanded. Consequently, a pressure inside of compression chamber 133 is decreased, thus starting to open suction valve 143 due to a difference between the pressure inside of compression chamber 133 and a pressure inside of suction muffler 149.

Refrigerant 105, which returns from the refrigeration cycle and has a low temperature, is once released inside sealed container 101 through suction pipe 106, and thereafter, is released to muffler space 159 through inlet tube 151 of suction muffler 149. Released refrigerant 105 flows into compression chamber 133 through outlet tube 155.

Subsequently, when piston 119 is operated from a bottom dead center in a direction in which the volume inside of compression chamber 133 is decreased, the pressure inside of compression chamber 133 is increased, so that suction valve 143 is closed due to the difference between the pressure inside of compression chamber 133 and the pressure inside of suction muffler 149.

Here, suction muffler 149 constitutes an expansion type muffler of inlet tube 151, outlet tube 155, and muffler space 159, thus reducing noise generated by intermittent suction of refrigerant 105.

Moreover, suction muffler 149 is made of a resin having a smaller thermal conductivity. A temperature of refrigerant 105 flowing in suction muffler 149 is influenced by heat generation in electromotive component 109, to be thus prevented from being increased, so that refrigerant 105 can be sucked into compression chamber 133 in a high density. Therefore, a mass and a flow rate of refrigerant 105 are increased, thereby enhancing volumetric efficiency.

Next, a description will be given of the operation of oil 103. Oil 103 reserved inside at a bottom of sealed container 101 is carried above compressive component 107 by a centrifugal force generated by the rotation of crankshaft 115 and oil supply mechanism 127 utilizing viscous frictional force generated at a slide portion. On a way, a part of oil 103 carried to compressive component 107 lubricates crankshaft 115 and the slide portion such as bearing 137, whereas residual oil 103 spatters from an upper end of crankshaft 115.

Oil 103 spattering in a space inside of sealed container 101 drops on a slide portion between piston 119 and cylinder 135, followed by lubricating. Oil 103 supplied for lubricating the slide portion is increased in temperature. However, oil 103 adheres to an inner surface of sealed container 101, and therefore, its heat radiates to the outside via sealed container 101, thus cooling the sealed compressor.

Furthermore, a part of oil 103 spattering in the space inside of sealed container 101 is sucked through inlet tube 151 of suction muffler 149 together with refrigerant 105.

Oil 103 sucked together with refrigerant 105 is released into muffler space 159 having a large volume through inlet tube 151, and thereat, a flow rate of refrigerant 105 is decreased. At this time, oil 103 is separated from refrigerant 105 as the flow rate of refrigerant 105 is decreased. In addition, oil 103 is separated from refrigerant 105 also owing to a shock caused by a collision of a part of refrigerant 105 against step 174 facing opening 173 and a disturbance together with an abrupt directional change of a refrigerant flow caused by the collision of refrigerant 105 against step 174. Most of separated oil 103 drops on the bottom of muffler space 159 by gravity.

Dropping oil 103 is drained to the outside of suction muffler 149 through oil drain port 175 formed at the bottom of muffler space 159 in the vicinity of opening 173 of inlet tube 151, and then, is reserved at the bottom inside of sealed container 101.

On the other hand, oil 103, which does not drop but spatters in muffler space 159, adheres onto the inner wall of muffler space 159 and to an outer surface of first outlet tube portion 167. In particular, oil 103 adhering to the outer surface of first outlet tube portion 167 is urged by its own weight and the flow of refrigerant 105, to be moved toward opening 161 of first outlet tube portion 167, and further, oil droplets are formed during the motion.

Oil droplets 103 are urged by the flow of refrigerant 105, to be then moved toward bent portion 165 along an inner wall of first outlet tube portion 167, as indicated by arrows in FIG. 2.

However, oil 103 moving along the inner wall of first outlet tube portion 167 is inhibited from being moved toward second outlet tube portion 169 by the effect of close sided space 171 defined above in the vicinity of bent portion 165 in outlet tube 155, and thus, remains inside of close sided space 171. In this manner, oil 103 remains inside of close sided space 171, to be thus prevented from flowing into compression chamber 133 in a large amount. Consequently, it is possible to prevent any generation of noise, and further, to stabilize the performance of the compressor.

Opening 161 of first outlet tube portion 167 is formed with the inclination in such a manner as to be located under bent portion 165 in the vertical direction. In addition, the bottom of close sided space 171 is formed with the inclination downward in the vertical direction toward first outlet tube portion 167.

As a result, oil 103 remaining inside of close sided space 171 can be discharged to muffler space 159 owing to gradients of the bottom of close sided space 171 and the lower portion of first outlet tube portion 167 during the stoppage of the flow of refrigerant 105 inside of suction muffler 149 such as the stoppage of the compressor. Consequently, oil 103 remaining inside of close sided space 171 can be prevented from overflowing into compression chamber 133.

Moreover, angle θ defined between the lower portion of first outlet tube portion 167 and the bottom of close sided space 171 is set to 163°. Therefore, the height of suction muffler 149 can be reduced in dimension. Furthermore, opening 161 of first outlet tube portion 167 is separated upward of the bottom of muffler space 159, so that oil 103 remaining at the bottom of muffler space 159 can be sucked directly to outlet tube 155, thus to be prevented from flowing in compression chamber 133.

Here, a decrease in angle θ of less than 135° is undesirable because not only the height becomes larger in dimension but also refrigerant 105 flows toward second outlet tube portion 169 so as to move oil 103 also toward second outlet tube portion 169. In contrast, an increase in angle θ reduces a downward component of its own weight out of components of force acting on oil 103 moving toward second outlet tube portion 169 along the inner wall of outlet tube 155, and therefore, oil 103 is undesirably liable to be moved toward second outlet tube portion 169.

Hence, angle θ is set to 163° in suction muffler 149 in the present embodiment. Preferably, it should range from 135° or more to 180° or less and, more preferably, it should range from 150° or more to 175° or less. In other words, even if angle θ is set to 180°, first outlet tube portion 167 can be kept in an inclined state since the bottom of close sided space 171 is inclined at a predetermined angle.

Consequently, it is possible to effectively inhibit oil 103 from being moved along the inner wall of outlet tube 155 by the effect of close sided space 171, so as to provide compact suction muffler 149 having stable performance.

Additionally, close sided space 171 is formed in predetermined length, so that it can function as a side branch type resonator capable of canceling a resonant mode affecting on radiated noise by outlet tube 155, thus preventing any generation of noise.

Although the description has been given of the embodiment in which close sided space 171 is defined at the upper portion of bent portion 165 of outlet tube 155, close sided space 171 may be defined in or at a lower portion of bent portion 165. Alternatively, it is possible to allow oil 103 to remain inside of close sided space 171 and prevent oil 103 from flowing inside of compression chamber 133 in a large amount as long as close sided space 171 is defined in the vicinity of bent portion 165, and further, to allow close sided space 171 to function as the side branch type resonator.

In addition, the shape of close sided space 171 is defined by first outlet tube portion 167 and second outlet tube portion 169, like in the present embodiment. Thus, close sided space 171 can be defined without any increase in number of component parts, thereby preventing any increase in cost.

A refrigeration device equipped with the above-described sealed compressor is low in noise and stable in performance.

INDUSTRIAL APPLICABILITY

As described above, the sealed compressor according to the present invention is widely applicable to not only a domestic electric refrigerator but also an air-conditioner, a vending machine, and other refrigeration devices.

REFERENCE MARKS IN THE DRAWINGS

101 sealed compressor
103 oil
105 refrigerant
106 suction pipe
107 compressive component
109 electromotive component
113 suspension spring
115 crankshaft
117 block
119 piston
121 connector
123 eccentric shaft
125 main shaft
127 oil supply mechanism
129 stator
131 rotor
133 compression chamber
135 cylinder
137 bearing
139 suction port
141 valve plate
143 suction valve
145 cylinder head
147 head bolt
149 suction muffler
151 inlet tube
153 muffler body
155 outlet tube
157 cover
159 muffler space
161, 163, 173 opening
165 bent portion
167 first outlet tube portion
169 second outlet tube portion
171 close sided space
175 oil drain port

The invention claimed is:

1. A sealed compressor having a sealed container housing a compressive component driven by an electromotive component, the compressive component comprising:
- a block defining a compression chamber;
- a suction valve disposed at an end of the compression chamber;
- a piston which makes a reciprocating motion inside of the compression chamber; and
- a suction muffler defining a muffler space communicating with the compression chamber, the suction muffler including:
  - a muffler body defining the muffler space; and
  - an outlet tube communicating the muffler space with the suction valve, the outlet tube having:
    - a bent portion bent in a middle portion between an opening exposed to the muffler space and an opening in the vicinity of the suction valve;
    - a first outlet tube portion extending from the bent portion toward the muffler space; and
    - a second outlet tube portion extending from the bent portion toward the suction valve;
- wherein a close sided space is formed in the outlet tube above the bent portion, the close sided space having one end in communication with the outlet tube and the other end closed.

2. The sealed compressor according to claim 1, wherein the first outlet tube portion is formed to be inclined downwardly toward the muffler space vertically from the bent portion, and the close sided space comprises a bottom portion being inclined downwardly toward the first outlet tube portion.

3. The sealed compressor according to claim 1, wherein an angle defined between the lower portion of the first outlet tube portion and the bottom of the close sided space is 135° or more and 180° or less.

4. A refrigeration device equipped with the sealed compressor according to claim 1.

* * * * *